US007559615B2

(12) United States Patent
Eve

(10) Patent No.: US 7,559,615 B2
(45) Date of Patent: Jul. 14, 2009

(54) INKJET DEVICE AND METHOD

(75) Inventor: Richard William Eve, Cambridge (GB)

(73) Assignee: Inca Digital Printers Limited (GB)

( * ) Notice: Subject to any disclaimer, the term of this patent is extended or adjusted under 35 U.S.C. 154(b) by 17 days.

(21) Appl. No.: 10/560,971

(22) PCT Filed: Jun. 11, 2004

(86) PCT No.: PCT/GB2004/002526

§ 371 (c)(1),
(2), (4) Date: Nov. 9, 2006

(87) PCT Pub. No.: WO2004/113084

PCT Pub. Date: Dec. 29, 2004

(65) Prior Publication Data

US 2007/0200902 A1 Aug. 30, 2007

(30) Foreign Application Priority Data

Jun. 16, 2003 (GB) ..... 0313962.3

(51) Int. Cl.
*B41J 29/38* (2006.01)
*B41J 2/195* (2006.01)
*B41J 2/19* (2006.01)
*B41J 2/17* (2006.01)

(52) U.S. Cl. ..... 347/6; 347/7; 347/84; 347/92

(58) Field of Classification Search ..... 347/6, 347/92–93, 7, 84
See application file for complete search history.

(56) References Cited

U.S. PATENT DOCUMENTS 5,341,162 A 8/1994 Hermanson et al.
5,852,459 A * 12/1998 Pawlowski et al. ..... 347/86
5,870,126 A 2/1999 Kondo et al.
5,909,231 A 6/1999 Childers et al.
6,007,193 A * 12/1999 Kashimura et al. ..... 347/92
6,082,851 A * 7/2000 Shihoh et al. ..... 347/85
6,336,700 B1 1/2002 Hays et al.
6,467,861 B1 * 10/2002 Thielman et al. ..... 347/6
6,547,377 B2 * 4/2003 Thielman et al. ..... 347/85
6,726,754 B2 * 4/2004 Lye et al. ..... 106/31.27
6,773,097 B2 * 8/2004 Dowell ..... 347/85

(Continued)

FOREIGN PATENT DOCUMENTS

EP 0 916 502 5/1999

(Continued)

*Primary Examiner*—Julian D Huffman
*Assistant Examiner*—Jason S Uhlenhake
(74) *Attorney, Agent, or Firm*—Harness, Dickey & Pierce, P.L.C.

(57) ABSTRACT

In an inkjet device for containing, degassing and supplying ink, gas is supplied to a container for the ink so that the gas bubbles through the ink in the container. A controller controls a gas supplying means to operate in at least two modes including a degassing mode in which the pressure in the container is at a degassing pressure and the gas supplying means is controlled to supply the gas at a pressure above the degassing pressure to bubble through the ink, and an ink supplying mode in which the container is at an ink delivery pressure. In preferred examples, the ink container is arranged for supplying ink to a printhead; using the degassing arrangement, the formation of bubbles in the ink at the printhead can be reduced.

33 Claims, 2 Drawing Sheets

U.S. PATENT DOCUMENTS

Figure 1:
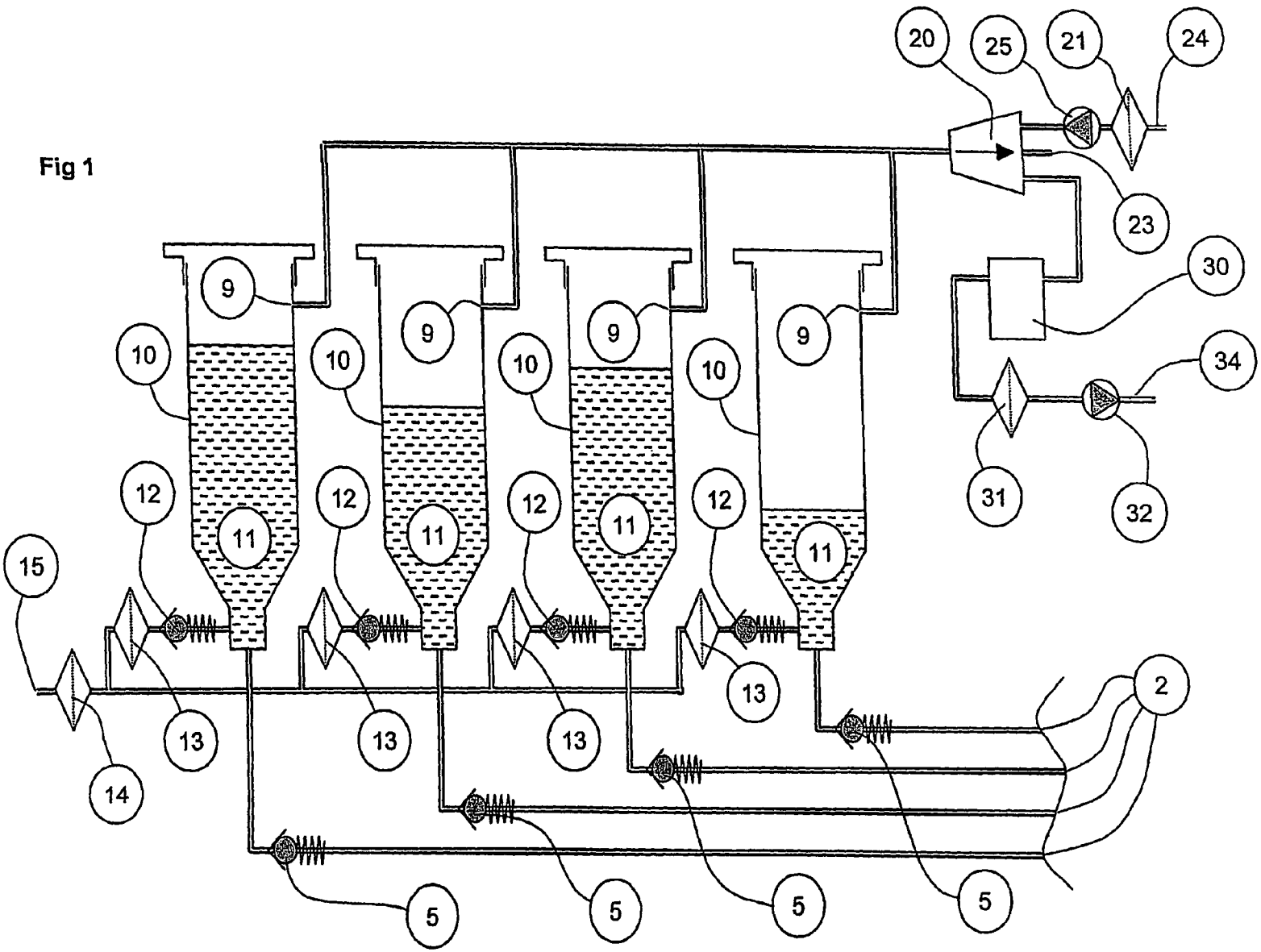

| | | | |
|---|---|---|---|
| 2001/0024223 | A1 | 9/2001 | DeVries et al. |
| 2002/0097284 | A1 | 7/2002 | Vosahlo |

FOREIGN PATENT DOCUMENTS

| | | | |
|---|---|---|---|
| EP | 1 167 044 | | 1/2002 |
| GB | 2 265 860 | A | 10/1993 |
| JP | 54-160242 | | 12/1979 |
| JP | 58-132563 | | 8/1983 |
| JP | 59-007054 | | 1/1984 |
| JP | 06-023349 | | 2/1994 |
| JP | 11-048493 | | 2/1999 |
| JP | 11048493 | | 2/1999 |
| JP | 2000-211160 | | 8/2000 |
| WO | WO 97/44194 | A | 11/1997 |
| WO | WO 01/28701 | | 4/2001 |
| WO | WO 02/28652 | | 4/2002 |

* cited by examiner

INKJET DEVICE AND METHOD

The invention relates to the degassing of fluids, particularly for use in an inkjet system.

It is well known that in inkjet systems, gas dissolved in the ink can cause serious problems. In many inkjet systems ink in a reservoir is exposed to air and as a result the ink becomes saturated with gas at an equilibrium level which depends on the pressure in the reservoir and the composition of the ink. This becomes a problem when the ink leaves the reservoir and is passed to the printheads, at which point the gas tends to come out of solution and form bubbles.

Gas is encouraged to come out of solution at the printhead because a piezoelectric inkjet printhead acts as an ultrasonic emitter in operation. Typically, printheads may have excitation frequencies of the order of 30 kHz. Ultrasonic vibrations are an effective way of removing gas from solution in a liquid, and since in a piezoelectric inkjet printhead the ink drops are ejected by acoustic waves from the piezoelectric head, this effect is inherent in operation of the printhead. In addition, ink is heated before being ejected from the printhead, reducing the solubility of gas in the ink and further encouraging gas to come out of solution.

The formation of bubbles in the ink due to gas coming out of solution at the printhead is known to cause problems, since a tiny bubble of air acts as a damper to acoustic energy transmitted along an ink path to the nozzle of the printhead. As a result the ink flow may be inhibited and often the nozzle stops ejecting ink completely.

These problems are especially severe when a pressurized ink system is used. In these systems ink is poured into a sealed container, which is pressurized with air so that pumps are not needed to supply the ink to the printheads. Due to the increased pressure, over time the ink becomes saturated with air at an equilibrium value above ambient.

Some commercial printers use an in-line degassing unit to reduce the amount of gas dissolved in the ink. Commercially available in-line degassing units include the Separel PF-10F, the Random Technologies 2.5×8 Degasser and the Spectra remote lung module.

The prior art degassing devices have several disadvantages. In-line degassing units are expensive and add bulk and complexity and the degree of degassing depends on the flow rate of ink. Typically the degasser has to be sized to degas the maximum flow rate of ink expected through the ink system, but most of the time the flow rate is very much lower, and often zero. When the flow rate of the ink is zero, the ink in the in-line unit continues to be degassed, resulting in the removal of a much greater proportion of the dissolved gas than during ink flow. For free radical ultra-violet curing inks, such a situation can take so much air out that the action of oxygen as an inhibitor to the ultra-violet curing reaction is affected. This could, for instance, make the ink more than usually sensitive to small amounts of ultra-violet light, which could in turn cause unwanted curing or part-curing of ink on the inkjet nozzle plates due to stray ultra-violet light.

An alternative prior art technique is to supply ink ready de-gassed in sealed containers with no headspace, or with a non-soluble gas in the headspace. However, such systems are awkward to load and unload, and it is still difficult to prevent re-gassing of the ink in the machine if it is left for periods of time without printing. Examples of such sealed ink containers are commonly found on desktop inkjet printers, such sealed ink containers comprising a flexible pouch and being fully disposable together with the printhead once the ink has been exhausted.

The term ink is intended herein to mean any substance capable of being used in an inkjet device, and is not limited to visually coloured fluids as used in printing. Examples of alternative uses of inkjet devices include micro-deposition of etch resist on printed circuit boards and deposition of active substances such as biological reagents and polymer LED materials. The invention can be applied to all such uses of inkjet systems, as will be appreciated by one skilled in the art.

The present invention alleviates the problems with existing methods and is particularly but not exclusively of value when using an air-pressurised ink supply.

In a first aspect of the invention, there is provided an inkjet device for containing, degassing and supplying ink, comprising a container for the ink; means for supplying a gas to the container to bubble through the ink; and a controller for controlling at least the gas supplying means to operate in at least two modes, including a degassing mode wherein the pressure in the container is at a degassing pressure and wherein the gas supplying means is controlled to supply the gas at a pressure above the degassing pressure to bubble through the ink; and an ink supplying mode wherein the pressure in the container is at an ink delivery pressure. Thus, somewhat counter-intuitively, gas is supplied to the ink to degas the ink. Bubbling of gas promotes attainment of equilibrium and by selection of the gas and/or pressure and/or temperature, the gas supplying means is arranged to supply gas to bubble through the ink in such a way that the ink in the containing means is degassed.

If the gas is a substantially insoluble gas (which must also be chemically compatible with the ink), which removes more soluble gases from solution in the ink as it bubbles through, degassing may be carried out at the ambient or the ink delivery pressure. However, a lower degassing pressure may be employed, and will be employed with a soluble gas, e.g. air. Preferably the supply of gas is inhibited in the ink supplying mode, particularly to conserve gas when a gas other than air is used, but in a simplified device the gas supplying means may supply gas continuously in all modes.

Examples of the invention find particular application in the field of inkjet printers. Preferably, the container is arranged for supplying ink to a printhead, preferably an inkjet printhead.

It will be understood that the ink may be supplied directly or indirectly to the printhead. For example, the ink may be supplied to a reservoir local to the printhead.

Preferably the printhead is remote from the container. This can be particularly advantageous since the degassing of the ink can take place away from the printhead, thus reducing the risk that gas bubbles would form in or near the printhead.

Preferably, the device further comprises means for setting the pressure in the container; and the controller is arranged to further control the pressure setting means to set the pressure in the container to the degassing pressure or ink delivery pressure according to the mode.

As mentioned above, degassing can be achieved using two methods with this apparatus. The degassing pressure may be lower than the ink delivery pressure, and a soluble gas may then be bubbled through the ink in the degassing mode. As a result, the level of dissolved gas in the ink is reduced to the equilibrium saturation value at the degassing pressure, which is less than the saturation value at the ink delivery pressure. Alternatively, if the gas supplying means is used to provide a gas less soluble in the ink than air, it is not necessary for the degassing pressure to be lower than the ink delivery pressure (although it may be) in order to degas the ink, provided that the gas supplying means supplies the gas at a pressure higher than the degassing pressure.

Preferably the temperature and pressure in the degassing mode and the gas solubility are selected so that the equilibrium mass proportion of dissolved gas in the ink in the degassing mode is no more than 80% of the saturation mass proportion at the ink delivery pressure and temperature. Preferably it is no more than 60% of the saturation mass proportion at the ink delivery pressure and temperature.

It will be appreciated by one skilled in the art that degassing according to this requirement can readily be achieved in a large variety of ways depending on the ink and conditions of interest. For example we have found that, if a soluble gas such as ordinary air is bubbled through the ink in the degassing mode, using a degassing pressure of around 450 mbar will result in the amount of gas in the ink being reduced to less than 60% of the saturation value at STP in around 10 minutes. Higher pressures may be used, particularly if temperature is increased. If a relatively insoluble gas is used, this can be bubbled through the ink in the degassing mode at a higher pressure and, using a highly insoluble gas such as Helium, the ambient or ink delivery temperature and pressure may be used and degassing achieved. A soluble gas such as air may be used with, a degassing pressure approximately equal to or only slightly below atmospheric pressure, and an elevated degassing temperature, typically above 40° C. In other conditions, various combinations of gas solubility, degassing pressure and degassing temperature may be used to achieve the desired extent of degassing outlined above.

The criteria are that, the more soluble the gas, the lower the pressure and/or the higher the temperature required. The selected temperature and pressure and choice of gas will depend on readily appreciated implementation conditions. For example, for a highly temperature stable ink, heating may be preferable to significant pressure reduction, reducing pumping requirements. It will be appreciated that, while conditions may vary, the effectiveness of a given set of degassing conditions can be tested readily. Most simply a sample of ink may be subjected to a vacuum, and the amount of gas given off per mass of ink measured. A sample of ink which has been exposed to the ink delivery conditions in the inkjet device without being degassed should be tested to determine the saturation proportion of gas in the ink, and another sample of the same ink which has been degassed in the inkjet device using a trial set of degassing conditions should also be tested. The mass proportion of gas in the ink after degassing can then be expressed as a percentage of the saturation mass proportion, and if this does not fall within the desired range, degassing conditions can be adjusted accordingly, using the principle of lowering pressure or raising temperature to reduce gas. As will be appreciated, the trial conditions do not need to be critically repeated, it is merely necessary to set up an operating regime which, under typical conditions, is inside desired limits.

The above arrangement provides the advantage that ink can be degassed in the containing means to a controllable extent. It has been found that after degassing the ink typically takes a period of several days to re-gas to its saturation level, so performing degassing in idle periods while ink is not being supplied, i.e. between print jobs when the invention is used in a printer system, is sufficient in many cases. The degassing function of the above apparatus is so effective that a 100% saturated ink (Sericol UviJet EV Cyan, Magenta, Yellow or Black for example) can be, reduced to 50% saturation in less than ten minutes using a pressure of about 450 mbar in the degassing mode. It is found that ink at 27° C. and less than 60% saturation level in the ink tanks allows reliable operation of the inkjet printheads, whereas ink at 27° C. and 90% saturation in the ink tanks is unreliable, when supplied at a typical temperature of 38° C. to the heads via the local ink refill system. Note that the percentage saturation levels described above refer to atmospheric pressure, thus the equilibrium level of gas in ink kept in a pressurised ink tank would exceed 100% saturation.

Preferably the degassing pressure is lower than the ink delivery pressure. Preferably the controller is further arranged to operate in an intermediate mode wherein the pressure in the container is set to an intermediate pressure intermediate said ink delivery pressure and said degassing pressure. Preferably the apparatus is controlled between modes by means of three-way valve means connected to the ink container.

Preferably, the device further comprises means for setting the temperature in the container to an elevated degassing temperature. More preferably the device further comprises means for cooling the ink to an ink delivery temperature below the degassing temperature. Preferably the cooling means is outside the container. Compared to the ink delivery conditions, a higher degassing temperature may be used additionally or alternatively to a lower degassing pressure to provide a lower equilibrium proportion of gas dissolved in the ink in the degassing mode. After cooling, the amount of gas dissolved in the ink is less than the saturation value at the lower temperature.

Preferably the apparatus further comprises at least one printhead and a local ink refill system associated with the or each printhead; wherein the container is arranged to supply ink to the at least one local ink refill system in the ink supplying mode. This arrangement is suitable for use in a printer. The, local ink refill systems supply ink selectively to the printheads, as is well known in the art. The free surface in the local ink refill system might be expected to take the ink towards 100% saturation. In practice the residence time is sufficiently short that this is not a significant effect.

Preferably the degassing pressure is lower than atmospheric pressure, and the gas supplying means is arranged to supply gas, preferably air, substantially at atmospheric pressure. A gas other than air, for example Nitrogen, may be supplied at atmospheric pressure, for example by using a filter means to extract a component gas from air. More preferably the degassing pressure is below 900 mbar. Most preferably the degassing pressure is below 600 mbar. Using a degassing pressure below atmospheric pressure means that the gas provided in the degassing mode can be air at atmospheric pressure, which avoids the running expense of providing a relatively insoluble gas at a pressure above ambient.

The air can be drawn into the ink containing means from an inlet open to the atmosphere via a filter system. The pressure is chosen to provide effective degassing to avoid bubble formation at the printheads, while not requiring an excessively expensive pressure reduction system. Another factor to be taken into consideration is that if the degassing pressure is too low, the gas coming out of solution in the ink will have too large a volume, which can result in bubbles entering the three way valve means and causing contamination.

Preferably, there is provided a bubble bursting means between the ink container and the three way valve means. Suitably, the bubble bursting means comprises a filter.

Preferably, the device further comprises a refillable ink reservoir selectively operable to supply ink to the container in the degassing mode. Preferably the refillable ink reservoir is exposed to atmospheric pressure. This apparatus provides the advantage that the ink supply may be refilled during operation of the device, regardless of the pressure state of the ink container.

Preferably the device further comprises at least one ink accumulator operably connected between the container and the at least one local ink refill system; wherein the or each ink accumulator is arranged to supply ink to the at least one local ink refill system; and wherein the containing means is selectively operable to supply ink to the ink accumulator. This apparatus provides a buffer between the ink containing means and the local ink refill systems, such that the ink containing means may be refilled during continuous printing without loss of ink supply to the printheads.

Preferably, in one embodiment, the gas supplying means is arranged to supply a gas less soluble in the ink than air. Suitably the gas is Helium. Using a substantially insoluble gas avoids the need for the pressure in the ink container to be lowered or positively adjusted, which simplifies the device, and allows the ink to be degassed while the containing means is operable to supply ink. Helium is inexpensive and readily available in pressurised containers, making it a suitable choice for the degassing apparatus.

Preferably the gas supplying means is arranged to supply gas to bubble through a major portion of the ink. Suitably, the gas supplying means includes an inlet adjacent the base of the container so that gas introduced bubbles upwardly through the container. The degassing process requires thorough mixing to maximise contact between the gas used and the ink, which is provided relatively simply by the above arrangement.

Preferably the ink container has a greater height than at least one of its horizontal dimensions. More preferably the ink container is generally columnar having a greater height than any horizontal dimension. This configuration allows the rising bubbles of gas from the gas supplying means to pass through a large proportion of the ink during degassing.

Preferably, there is provided printing apparatus comprising a plurality of ink containing and supplying devices, each as described above. More preferably, each ink containing and supplying device contains ink of a different colour. This apparatus is suitable for use in colour printing, and the degassing apparatus can be extended to any number of ink containers in a printing system, either using the same or separate gas supplying means for each container.

Preferably the apparatus further comprises at least one filter positioned to filter gas flowing from the gas supplying means to the ink container. Preferably the device further comprises restriction means for restricting the flow of gas from the gas supply means to the ink container. More preferably the restriction means is provided by the at least one filter. Filtering the gas entering the ink container prevents the ink becoming contaminated during degassing, and restricting the flow of gas prevents the degassing process from becoming too vigorous and also conserves gas if the gas supplying means has a finite supply.

A further aspect of the invention comprises a method for degassing ink in a container in an inkjet device, comprising controlling the inkjet device between two modes of operation, including a degassing mode, in which the pressure in the container is at a degassing pressure and gas is supplied by gas supplying means at a pressure above the degassing pressure to bubble through the ink, and an ink supplying mode, in which the pressure in the container is at an ink delivery pressure.

Preferably the method further comprises setting the pressure in the container to the degassing pressure or the ink delivery pressure depending on the mode.

Preferably the degassing pressure is lower than the ink delivery pressure. Preferably the method further comprises setting the temperature in the container to an elevated degassing temperature. More preferably the method further comprises cooling the ink to an ink delivery temperature below the degassing temperature. Preferably the cooling is performed outside the container. Suitably the degassing pressure is lower than atmospheric pressure and the gas supplied is at atmospheric pressure, and preferably the gas is air.

Suitably the gas supplied is less soluble in the ink than air.

The invention extends to methods and/or apparatus substantially as herein described with reference to the accompanying drawings.

Any feature in one aspect of the invention may be applied to other aspects of the invention, in any appropriate combination. In particular, method aspects may be applied to apparatus aspects, and vice versa.

Figure 2:
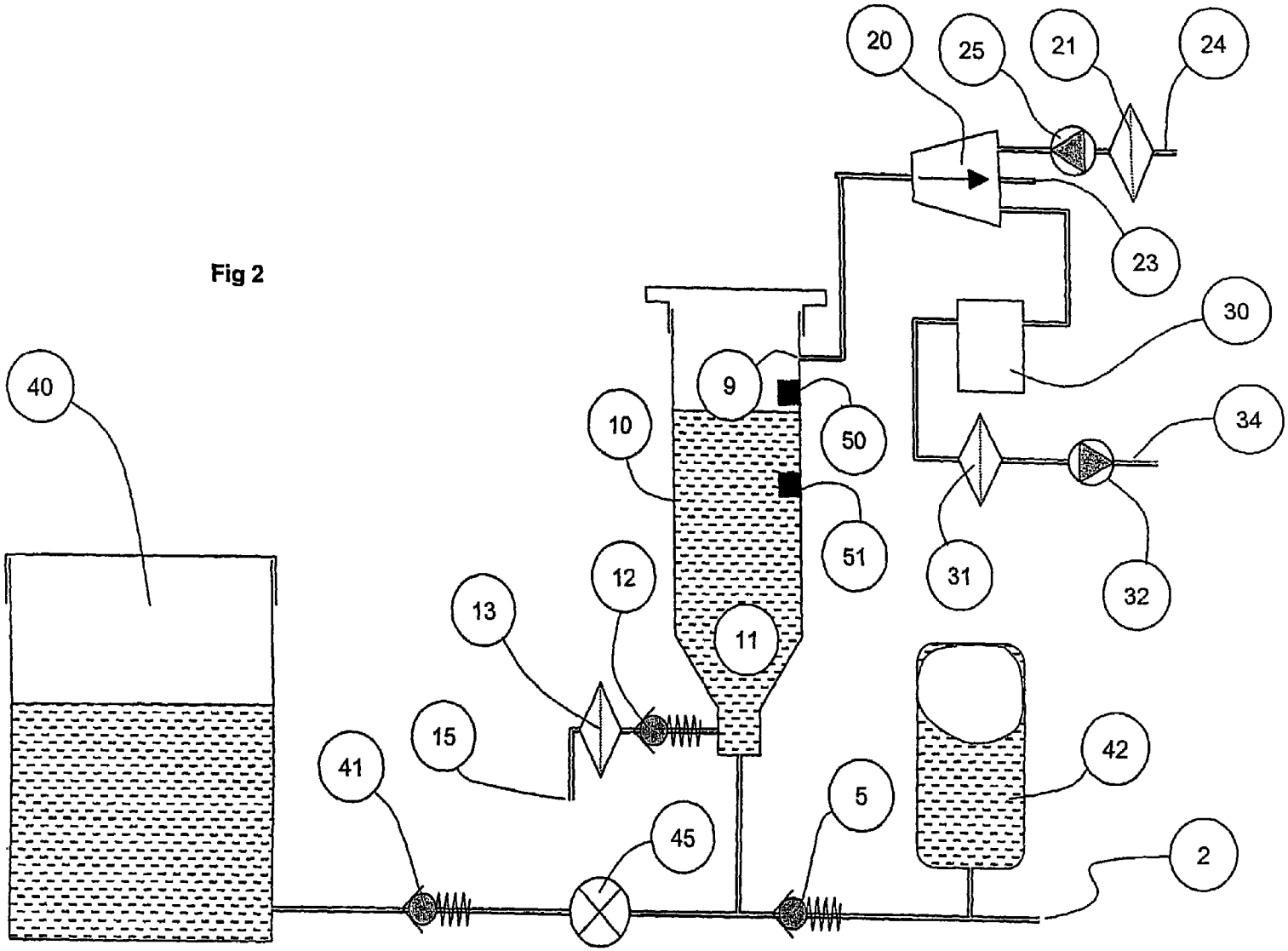

Preferred features of the present invention will now be described, purely by way of example, with reference to the accompanying drawings, in which:

FIG. 1 shows schematically an ink supply system including means for degassing the ink; and FIG. 2 shows schematically a further example of an ink supply system including means for degassing the ink.

The following is a detailed description of one embodiment of the invention by way of example only, and refers to FIG. 1.

Four ink tanks 10 are shown, which might contain Cyan, Magenta, Yellow and Black inks. In operation these tanks may contain varying amounts of ink 11. When printing, the system operates in a first state in which the three-way valve 20 connects the ink tanks to the air inlet 24 via a filter 21 and a pump 25, which pressurises the air (it is also possible to connect inlet 24 to a pressurised air line if available, and hence dispense with the pump 25). Thus the ink tanks are pressurised with clean air to a pressure of (typically) several hundred millibars above atmospheric pressure. Practical implementations of this system may have a secondary control means controlling the pump so that it switches on only when needed, and a plenum to provide a buffer of pressurised air.

The inks are therefore urged to pass out of the ink tanks 10, but are unable to pass through the check valves 12 which are arranged such as to allow flow into the ink tanks but not out of them. The ink therefore has to pass through the check valves 5 through the tubes 2 which are connected to local ink refill systems of a known type (not shown), which allow ink to flow only when needed by the inkjet printer. An example of such a system is described in WO-A-0068018. It can be seen that, in the said first state, the ink system supplies ink to the local ink refill systems whenever needed, without the need for separate liquid pumps.

FIG. 1 also shows means by which the equipment can be used to degas the ink. When the printer is not operating, the three-way valve 20 can be set in a second state to exhaust the tank to atmospheric pressure through the direct outlet 23, and then set in a third state to connect the tanks to outlet 34 via a vacuum pump 32, a filter 31, and a liquid trap 30. In this third state, the air in the tanks 10 is pumped out through port 9 via the three-way valve 20, but the vacuum thus created causes air to flow in to the tanks 10 from the inlet 15 through the fine filter 14, and then individually through the coarse filters 13 and the check valves 12. The check valves 5 stop any ink from being sucked into the tanks 10. The check valves 12 are non-return valves with a "cracking" pressure of around 200 mbar, so that the bubbling of air through the ink stops as the tank is re-pressurised while switching from the third state to the second state. The check valves 12 are adapted to stop the degassing process when the pressure in the tank exceeds a set threshold, chosen to avoid the re-gassing of the ink which would otherwise occur on switching from the third state to the second state.

In the third state therefore, air will enter the tanks 10 and bubble through the ink due to the low pressure in the headspace. It can be seen that the arrangement operates in a similar way to known bubble columns used to react gases and liquids. The pressure at the bottom of each tank 10 will in fact be different because of the different amounts of ink in each tank, but the vacuum applied to the headspaces is preferably such that the variation is small. In one embodiment the pressure in the headspace in the third state is around 500 mbar.

The coarse filters 13 stop dirt particles from entering the ink, but in this case are also used to restrict the flow rate of air into the tanks 10. These two functions could of course be achieved using separate filtration and restrictor means. In the embodiment illustrated by FIG. 1, filter 13 is a Millex FG Durapore 0.45 micron filter, 4 mm diameter. This allows about 0.5 litres/minute of air at STP into each tank when the absolute pressure in the headspace is at 500 mbar. The check valves 12 reduce the, pressure difference across the filters to around 300 mbar due to their cracking pressure. A filter is an effective way to restrict the air flow because it does not depend upon a single orifice which could become blocked with dirt. When used as a restrictor in this way, it is best to protect the filter with an upstream filter 14 of smaller pore size but larger area such that there is relatively little restriction to the flow. An example of a suitable protective filter 14 is a Whatman 12 ml filter tube with a 0.2 micron pore size, part 6984-1202, used in conjunction with the Millex FG filters 13.

After the degassing function has been completed, the three-way valve 20 can be set to the second state to bring the ink tanks to atmospheric pressure, and then back to the first state to allow printing. The operation of the valve can be manual or automatic, and if automatic can be done upon a button-push command by an operator or by the machine itself when it senses that it is appropriate to do so (for example when the machine has been idle for a set period of time or when one of the ink tanks has been refilled).

If a substantially insoluble sparging gas such as Helium is used instead of air, degassing can be achieved much more simply by connecting a pressurised gas source to inlet 15 and bubbling said gas through ink tanks when they are pressurised in the first state. There is no need for the tanks to be subjected to vacuum, which is advantageous, but there is a requirement to supply said gas, which is a running expense.

In a second embodiment, described below by way of example, the system operates in a manner allowing continuous printing even while refilling an ink reservoir. The embodiment is as shown in FIG. 2, to which the following refers. For clarity one colour system is shown, but the system can be used for multiple colours as shown in FIG. 1. A refillable ink reservoir 40 is at atmospheric pressure at all times, and may be refilled without stopping the printer. Ink may flow out of the reservoir 40 through the check valve 41 and the valve 45. The ink tank 10 may be operated at positive gauge pressure, or vented to atmosphere, or subjected to a vacuum using the three-way valve 20 as in the first embodiment. The ink tank 10 is equipped with a high-level ink sensor 50 and a low-level ink sensor 51.

Normally the system operates with the three-way valve in the third state in which the headspace of tank 10 is connected to outlet 34 via a three-way valve 20, a liquid trap 30, a filter 31, and a vacuum pump 32. In this state air is drawn in through inlet 15, through filter 13 and check valve 12, and allowed to bubble through the ink contained in tank 10. The ink is thus effectively degassed as previously described. Between the ink tank 10 and the printer, there is a check valve 5 and a connected accumulator 42, which holds ink at pressure and expels ink to the printer. Tube 2 is connected to local ink refill systems of a known type (not shown), which allow ink to flow in only when needed by the inkjet printer.

The accumulator is equipped with high- and low-level sensors (not shown) which act in a similar way to those in ink tank 10. If the ink level in accumulator 42 drops below its low-level sensor, the ink tank 10 is put into the second state (with its headspace connected to atmosphere) and then in to the first state with the headspace pressurised. The pressurization of the headspace is such that the pressure exceeds that needed fully to charge the accumulator 42, so ink flows from the ink tank 10 through the check valve and fills the accumulator 42 (note that, if the local ink refill systems open, some of the ink may also flow directly into the local ink refill systems). When the ink level in accumulator 42 reaches its high-level switch, the ink tank 10 is put into the second state, stopping the ink flow, and then into the third state.

If the ink level in tank 10 falls below the level of the low-level ink sensor 51, the three-way valve is put into said third state to connect the tank 10 to inlet 34 via a vacuum pump 32, a filter 31, and a liquid trap 30, and the valve 45 is opened, allowing ink to flow from reservoir 40 into tank 10. When the ink level in tank 10 reaches the high-level ink sensor 50, the valve 45 is shut.

It will be understood that the present invention has been described above purely by way of example, and modification of detail can be made within the scope of the invention.

Each feature disclosed in the description, and (where appropriate) the claims and drawings may be provided independently or in any appropriate combination.

The invention claimed is:

1. An inkjet-device for containing, degassing and supplying ink to a printhead, the device, comprising:

a container for containing the ink and for supplying ink to the printhead;

means for supplying a gas to the container to bubble through the ink in the container;

a controller for controlling at least the gas supplying means to operate in at least two modes, including:

a degassing mode wherein the pressure in the container is at a degassing pressure and wherein the gas supplying means is controlled to supply the gas at a pressure above the degassing pressure to bubble through the ink; and an ink supplying mode wherein the pressure in the container is at an ink delivery pressure.

2. Apparatus according to claim 1, further comprising a printhead remote from the container.

3. Apparatus according to claim 1, further comprising means for setting the pressure in the container; and wherein the controller is arranged to control the pressure setting means to set the pressure in the container to the degassing pressure or ink delivery pressure according to the mode.

4. Apparatus according to claim 3, wherein the degassing pressure is lower than the ink delivery pressure.

5. Apparatus according to claim 3, further comprising a bubble bursting means between the ink container and the pressure setting means.

6. Apparatus according to claim 1, wherein the temperature and pressure in the degassing mode and the gas solubility are selected so that the equilibrium mass proportion of dissolved gas in the ink in the degassing mode is no more than 80% of the saturation mass proportion at the ink delivery pressure and temperature.

7. Apparatus according to claim 6, wherein the equilibrium mass proportion of dissolved gas in the ink in the degassing mode is no more than 60% of the saturation mass proportion at the ink delivery pressure and temperature.

8. Apparatus according to claim 1, further comprising means for setting the temperature in the container to an elevated degassing temperature.

9. Apparatus according to claim 8, further comprising means for cooling the ink to an ink delivery temperature below the degassing temperature.

10. Apparatus according to claim 9, wherein the cooling means is outside the container.

11. Apparatus according to claim 1, further comprising at least one printhead and a local ink refill system associated with the or each printhead; wherein the container is arranged to supply ink to the at least one local ink refill system in the ink supplying mode.

12. Apparatus according to claim 1, wherein the degassing pressure is lower than atmospheric pressure, and the gas supplying means is arranged to supply gas, preferably air, substantially at atmospheric pressure.

13. Apparatus according to claim 1, wherein the degassing pressure is below 900 mbar.

14. Apparatus according to claim 1, wherein the degassing pressure is below 600 mbar.

15. Apparatus according to claim 1, wherein the gas supplying means is arranged to supply a gas less soluble in the ink than air.

16. Apparatus according to claim 15, where the gas is Helium.

17. Apparatus according to claim 1, wherein the gas supplying means is arranged to supply gas to bubble through a major portion of the ink.

18. Apparatus according to claim 1, wherein the gas supplying means includes an inlet adjacent the base of the container so that gas introduced bubbles upwardly through the container.

19. Apparatus according to claim 1, wherein the ink container has a greater height than at least one of its horizontal dimensions.

20. Apparatus according to claim 1, wherein the ink container is generally columnar having a greater height than any horizontal dimension.

21. Printing apparatus comprising a plurality of inkjet devices, each as described in claim 1.

22. Apparatus according to claim 21, wherein each inkjet device contains ink of a different colour.

23. Apparatus according to claim 1, further comprising at least one filter positioned to filter gas flowing from the gas supplying means to the ink container.

24. Apparatus according to claim 23, further comprising restriction means for restricting the flow of gas from the gas supplying means to the ink container.

25. Apparatus according to claim 24, wherein the restriction means is provided by the at least one filter.

26. A method for degassing ink in a container in an inkjet device, the container being arranged for supplying ink to a printhead, the method comprising controlling the inkjet device between two modes of operation, including: a degassing mode, in which the pressure in the container is at a degassing pressure and gas is supplied by gas supplying means at a pressure above the degassing pressure to bubble through the ink in the container; and an ink supplying mode, in which the pressure in the container is at an ink delivery pressure when the device is supplying ink to the printhead.

27. A method according to claim 26, further comprising setting the pressure in the container to the degassing pressure or the ink delivery pressure depending on the mode.

28. A method according to claim 27, wherein the degassing pressure is lower than the ink delivery pressure.

29. A method according to claim 26, further comprising selling the temperature in the container to an elevated degassing temperature.

30. A method according to claim 29, further comprising cooling the ink to an ink delivery temperature below the degassing temperature.

31. A method according to claim 30, wherein cooling is performed outside the container.

32. A method according to claim 26, wherein the degassing pressure is lower than atmospheric pressure and the gas supplied is at atmospheric pressure, and preferably wherein the gas is air.

33. A method according to claim 26, wherein the gas supplied is less soluble in the ink than air.

* * * * *